United States Patent [19]

Topliffe

[11] 4,373,688

[45] Feb. 15, 1983

[54] CANARD DRIVE MECHANISM LATCH FOR GUIDED PROJECTILE

[75] Inventor: Roger O. Topliffe, Amherst, N.H.

[73] Assignee: The United States of America as represented by the Secretary of the Army, Washington, D.C.

[21] Appl. No.: 225,596

[22] Filed: Jan. 19, 1981

[51] Int. Cl.[3] ..... F42B 15/16

[52] U.S. Cl. ..... 244/3.24

[58] Field of Search ..... 244/3.24, 3.28, 45 A

[56] References Cited

FOREIGN PATENT DOCUMENTS 1517053 7/1978 United Kingdom ..... 244/3.24

*Primary Examiner*—Stephen C. Bentley
*Assistant Examiner*—Maureen Ryan
*Attorney, Agent, or Firm*—Nathan Edelberg; Robert P. Gibson; Max Yarmovsky

[57] ABSTRACT

A latching pin is held in a mating hole by a retaining wire prior to firing of a guided projectile to lock together a canard frame and an intermediate body which is part of a canard deflecting mechanism. Upon launch, the retaining wire is sheared by an inertia-driven shear mass but the latch pin is maintained in the latching condition by centrifugal force imparted to the canard frame and intermediate body during launch. Following launch, the canard frame and intermediate body are despun by aerodynamic drag on canards. Once despinning has proceeded sufficiently to reduce the centrifugal force to a value low enough to be overcome by a resilient member, the latch pin is withdrawn from the mating hole and relative rotation of the intermediate body and the canard frame are permitted to thus begin deflecting a pair of deflectable canards for producing aerodynamic lift to steer the projectile.

6 Claims, 2 Drawing Figures

CANARD DRIVE MECHANISM LATCH FOR GUIDED PROJECTILE

GOVERNMENTAL INTEREST

The invention described herein was made in the course of a contract with the Government and may be manufactured, used and licensed by or for the Government for governmental purposes without the payment to us of any royalty thereon.

BACKGROUND OF THE INVENTION

The present invention relates to guided projectiles and, more particularly, to guided gun-launched projectiles having steering canards for developing aerodynamic lift resulting in improved circular error probabilities (CEPs).

One method of improving precision of gun-launched munitions is to incorporate a target seeker therein with appropriate electronics for developing control signals and providing means for developing aerodynamic lift to correct errors in the flight path. Such means for developing aerodynamic lift can include one or more canards in a guidance assembly which are preferably maintained in the neutral position during launch and are later controlled according to the guidance signals.

Conventional projectiles typically spin at relatively high spin rates imparted by rifling in the barrel.

In order to properly absorb launch acceleration, it is necessary to permit rigid mechanical coupling between the portion of the guidance assembly carrying the canards and the remainder of the projectile body. After launch, it is desirable to despin the portion of the guidance assembly including the canards until they are substantially roll stationary in geocentric coordinates. Sensor outputs may thereupon be used to roll the plane in which aerodynamic lift may be exerted and control signals may thereupon be used to deflect deflectable canards as required to produce aerodynamic lift in that plane.

It is desirable to prevent premature deflection of the deflectable canards until the canards are despun. One method of preventing such deflection includes the friction of a reduction gearing device in the canard drive. However, unbalance of inertias of the reduction gearing device or the remainder of the drive train may permit the movable canards to deflect prematurely.

OBJECTS AND SUMMARY OF THE INVENTION

It is an object of the present invention to provide a guidance assembly for a projectile which overcomes the drawbacks of the prior art.

More particularly, it is an object of the present invention to provide a guidance assembly for a projectile which includes a latch for a canard drive mechanism to prevent premature deflection of deflectable canards.

It is a further object of the invention to provide a canard drive mechanism latch which remains in a latching condition until centrifugal force on a canard frame is reduced below a predetermined value.

According to an aspect of the invention, there is provided a guidance mechanism for a projectile of the type which imparts a spin to at least a portion of the guidance mechanism during launch which spin is reduced by despinning after launch, the guidance mechanism including at least one deflectable canard and a canard drive mechanism for deflecting the at least one deflectable canard with respect to the projectile, and a drive mechanism lock comprising means for immobilizing the canard drive mechanism prior to launch, means for releasing the means for immobilizing under launch acceleration of the projectile, and means for maintaining the means for immobilizing effective until the spin is reduced to a predetermined value.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
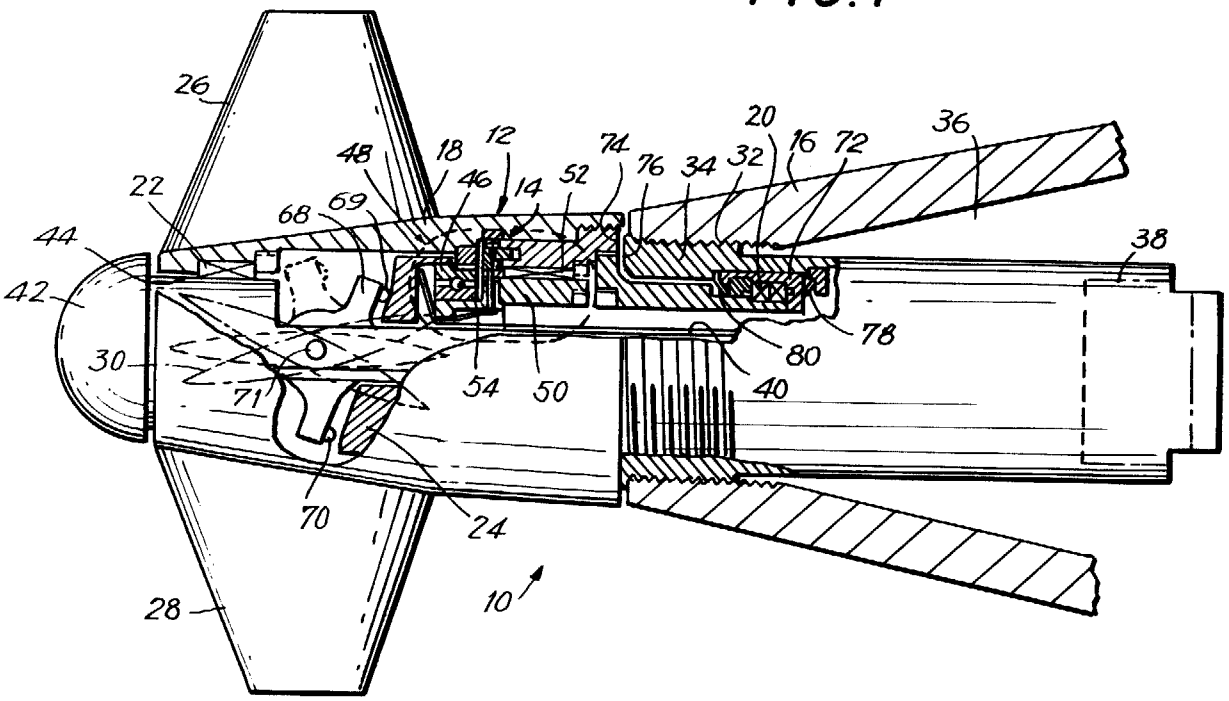
FIG. 1 shows a forward section of a projectile including a guidance assembly in partial cross section wherein the guidance assembly contains a canard drive mechanism latch according to an embodiment of the present invention.

Referring now to FIG. 1, there is shown, generally at 10, the forward portion of a projectile such as, for example, a 5-inch shell having mounted thereon a guidance assembly 12 employing a canard drive mechanism latch 14 according to an embodiment of the present invention.

Projectile 10 contains three elements which are independently rotatable about a common axis. These elements are a projectile body in casing 16 and certain additional elements attached thereto, a canard frame 18 which is rotatable with respect to projectile body 16 by virtue of bearings 20 and 22, and a steering canard drive cam 24. As will be more fully described hereinafter, projectile body 16 spins in flight due to an initial spin imparted, for example, by rifling in a gun as well as due to possible canted tail fins designed to maintain spin after launch. Canard frame 18 is initially spun up to about the same rate as projectile body 16 and is thereafter despun due to the aerodynamic drag of a pair of fixed canards 26 and 28 as well as a pair of deflectable canards 30 (only one of which is shown). After despinning, canard frame 18 is maintained substantially stationary in roll with respect to geocentric coordinates while projectile body, and parts attached thereto, rotate at a substantial rate.

A fuze well 32 includes threads thereon which engage corresponding threads on an aft body 34 of guidance assembly 12. Aft body 34, which is thus rigidly affixed to projectile body 16, extends into the interior 36 of projectile body 16. Aft body 34 contains therein necessary sensor processing apparatus in any convenient location such as in electronics compartment 38.

A central shaft 40, rigidly affixed to aft body 34, passes axially through canard frame 18 to support a sensor head 42 forward of canard frame 18. An inner race of bearing 22 is attached to the perimeter 44 of a portion of sensor head 42 to thus stabilize the forward end of canard frame 18 and to permit relative rotation therebetween. The aft end of canard frame 18 is rotatably supported on bearing 20.

Steering canard drive cam 24 is an annular cam surrounding central shaft 40 which is affixed to rotate with an outer member 46 of a reduction gearing device 48.

An intermediate body 50, which is relatively rotatably supported on canard frame 18 by a bearing 52 has attached thereto an inner member 54 of reduction gearing device 48.

Reduction gearing device 48 may be of any convenient reduction gearing apparatus but is preferably a Harmonic Drive which is a trademark of USM Corporation. A Harmonic Drive provides a high reduction ratio in a compact, light-weight assembly. The input element is a wave generator which consists of an elliptic ball bearing that imparts a rotating wave motion to a flexible ring. Spline teeth on the outer surface of the flexible ring progressively mate with the inner surface teeth of two circular rigid splines. These circular splines have slgihtly differing numbers of teeth so that, as the flexible ring moves, relative motion is produced between the rigid splines. One of the rigid splines is fixed to the housing and the other is free to rotate to thus rotate steering canard drive cam 24. The gear reduction ratio of 110:1 is preferred.

A cam follower 68 has two opposed points of contact 69 and 70 with steering canard drive cam 24. Cam follower 68 is directly connected through a shaft 71 to deflectable canards 30. Thus, when canard drive cam 24 is rotated, cam follower 68 and deflectable canards 30 may be rotated between the solid line and dashed line extremes shown in FIG. 1. The ratio of rotation of canard drive cam 24 to deflectable canards 30 is preferably about 4:1 for a total reduction gearing of about 440:1.

When projectile 10 is fired, canard frame 18 and parts attached thereto are permitted to move rearward until an abutment surface 74 on canard frame 18 rests against a forward abutment surface 76 of aft body 34. Centering spring 78 in shock block assembly 72 permits this aftward movement of canard frame 18. This aft movement and support of canard frame 18 prevents Brinnelling of bearing 20 due to the forces it would otherwise be required to sustain. Centering spring 78 returns canard frame 18 in the forward direction after projectile 10 leaves the barrel and a second centering spring 80, opposing centering spring 78, tends to maintain shock block assembly 72 and bearing 20 in an equilibrium position.

Due to the fact that direct contact between abutment surfaces 74 and 76 are required during projectile launch, canard frame 18 emerges from the barrel of the launching gun with substantially the same spin as projectile body 16. Once free of the barrel and of the launch acceleration, canards 26, 28 and 30 apply aerodynamic drag to canard frame 18 which, free of frictional contact with aft body 34, begins to reduce its spin. Canards 26 and 28 are canted to provide a torque in a direction opposite to the spin of projectile body 16. Thus, if nothing were done to prevent it, canards 26 and 28 would force canard body 18 to spin in a direction opposite to the spin of projectile body 16.

A sensor (not shown) rotating with projectile body 16 senses the rotational frequency of projectile body 16. Although not necessary for the practice of the invention, the sensor may include an infra-red scanner (not shown) in sensor head 42 which, spinning with projectile body 16, produces a signal which is related in frequency and phase to the rotation of projectile body 16. A further sensor (not shown) is employed to sense the relative rotation between projectile body 16 and canard frame 18. As would be clear to one skilled in the art, when the relative rotation between projectile body 16 and canard frame 18 equals the rotation frequency of projectile body 16, canard frame 18 is roll stationary in geocentric coordinates.

During launch, and until canard frame 18 is despun at a relatively low roll rate, deflectable canards 30 should remain in the fore-and-aft position shown in dot-dash line to avoid disturbance of the flight path. In order to maintain deflectable canards 30 in this position, intermediate body 50 must be locked to canard frame 18 to avoid actuation of reduction gearing device 48 due to unbalance of inertias of the drive train which could cause deflectable canards 30 to deflect prematurely.

Figure 2:
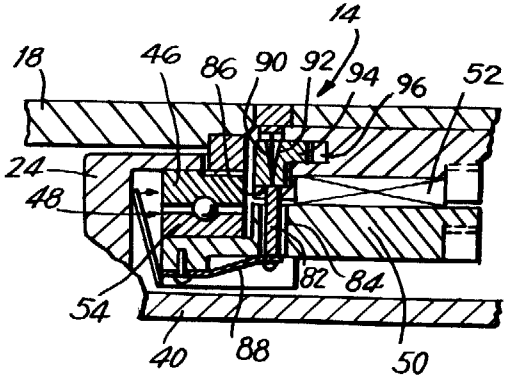
FIG. 2 is an enlarged cross section of the canard drive mechanism latch of FIG. 1.

Referring now to FIG. 2, canard drive mechanism latch 14, which is effective to lock intermediate body 50 to canard frame 18 during launch and until despinning is substantially completed, is shown in greater detail. The configuration in FIG. 2 represents the condition of canard drive mechanism latch 14 prior to firing.

A latch pin 82 extends through a hole 84 in intermediate body 50 and into a mating hole 86 in a portion of canard frame 18. A resilient member such as, for example, a flat spring 88 urges latch pin 82 outward from mating hole 86. The urging of flat spring 88 is resisted by a retaining wire 90. Retaining wire 90 passes through a tapered hole 92 in a retaining wire shear mass 94.

Retaining wire shear mass 94 is free to move in the longitudinal direction in a cavity 96 but is normally restrained from doing so by the presence of retaining wire 90.

Upon firing of projectile 10, retaining wire shear mass 94 is moved rearward in cavity 96 by the setback force and thus shears retaining wire 90. This frees latch pin 82 which is not, however, retracted from mating hole 86 at this time due to the high friction developed between latch pin 82 and mating hole 86 resulting from the acceleration both in longitude and spin occurring during launch. In addition, the spin of canard frame 18 with intermediate body 50 latched thereto produces a centrifugal force which holds latch pin 82 in the outward latching position shown. Latch pin 82 remains in the outward latching position shown after launch until despinning is substantially completed. When despinning is substantially completed, the force exerted by flat spring 88 is able to overcome the remaining centrifugal force tending to hold latch pin 82 in the latching position shown and thus withdraws latch pin 82 from mating hole 86 to thereby release intermediate body 50 which may thereupon be driven relative to central shaft 40 by motor 62.

Having described specific embodiments of the invention with respect to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A guidance mechanism for a projectile of the type which imparts a spin to at least a portion of the guidance mechanism during launch which spin is reduced by despinning after launch, said guidance mechanism including at least one deflectable canard and a canard drive mechanism for deflecting said at least one deflectable canard with respect to said projectile, and a drive mechanism lock comprising:

means for immobilizing said canard drive mechanism prior to launch;

means for releasing said means for immobilizing under launch acceleration of said projectile; and means for maintaining said means for immobilizing effective until said spin is reduced to a predetermined value.

2. A guidance mechanism according to claim 1, wherein said at least a portion of the guidance mechanism includes a canard frame rotatable with respect to said projectile, said canard drive mechanism includes an intermediate body rotatable with respect to both said projectile and said canard frame, and said means for immobilizing includes a latch pin engaging said intermediate body and said canard frame.

3. A guidance mechanism according to claim 2, wherein said means for immobilizing includes a holding member holding said latch pin in its engaging position.

4. A guidance mechanism according to claim 3, wherein said means for releasing includes a shear mass movable with respect to said holding member under said launch acceleration and effective to sever said holding member.

5. A guidance mechanism according to claim 4, wherein said means for maintaining includes disposing said latch pin such that centrifugal force of said spin maintains said latch pin in its engaging position until said spin is reduced to said predetermined value and said means for releasing further includes a resilient member effective to disengage said latch pin from one of said intermediate body and said canard frame when said spin is reduced to said predetermined value whereby said guidance mechanism is enabled to control said at least one deflectable canard.

6. A guidance mechanism for a gun-launched projectile comprising:

a guidance assembly fittable on the forward end of said projectile;

said guidance assembly including a canard frame having means for permitting rotation thereof about an axis of said projectile;

first and second canards on said canard frame mounted for common rotation about an axis for development of aerodynamic lift;

a canard drive mechanism in said canard frame operative to rotate said canards;

said canard drive mechanism having at least one part movable with respect to said canard frame for rotating said canards;

a latch pin having first and second positions;

said latch pin being effective in its first position to prevent movement of said at least one part with respect to said canard frame whereby rotation of said canards is prevented;

said latch pin being effective in its second position to permit movement of said at least one part with respect to said canard frame whereby rotation of said canards is permitted;

means for holding said latch pin in said first position until a predetermined longitudinal acceleration is applied to said guidance mechanism; and means for continuing to hold said latch pin in said first position after occurrence of said predetermined longitudinal acceleration is applied until a spin of said canard frame and said at least one part is less than a predetermined value.

* * * * *